US009187893B2

(12) United States Patent
Stanfill

(10) Patent No.: US 9,187,893 B2
(45) Date of Patent: Nov. 17, 2015

(54) METHOD AND APPARATUS FOR UNDER MOUNTED SKIRT FOR A MOBILE HOME

(71) Applicant: Heath G. Stanfill, Foristell, MO (US)

(72) Inventor: Heath G. Stanfill, Foristell, MO (US)

(73) Assignee: Heath G. Stanfill, Foristell, MO (US)

( * ) Notice: Subject to any disclaimer, the term of this patent is extended or adjusted under 35 U.S.C. 154(b) by 0 days.

(21) Appl. No.: 14/172,284

(22) Filed: Feb. 4, 2014

(65) Prior Publication Data

US 2015/0218793 A1 Aug. 6, 2015

(51) Int. Cl.
*B60R 13/04* (2006.01)
*E04B 1/343* (2006.01)

(52) U.S. Cl.
CPC ..... *E04B 1/34342* (2013.01)

(58) Field of Classification Search
CPC ..... B60P 3/32; B60R 13/04; B60R 13/0869; B60R 2013/046; E04B 1/34315; E04B 1/34321
USPC ..... 296/82, 164, 191, 180.4, 186.5, 184.1; 52/169.12; 280/768
See application file for complete search history.

(56) References Cited

U.S. PATENT DOCUMENTS 3,216,741 A * 11/1965 Newlin et al. ..... 280/768
3,694,979 A * 10/1972 Vadnie ..... 52/169.12
3,814,472 A * 6/1974 Zelikovitz ..... 296/180.4
3,832,813 A * 9/1974 Hindman ..... 52/169.12
4,010,963 A * 3/1977 Prentice ..... 280/768
4,043,088 A * 8/1977 Payton ..... 52/169.12
4,352,261 A * 10/1982 Wargo ..... 52/169.12
4,400,919 A * 8/1983 Szabo et al. ..... 52/169.12
4,549,378 A * 10/1985 Ayers et al. ..... 52/169.12
4,746,160 A * 5/1988 Wiesemeyer ..... 296/180.2
4,843,793 A * 7/1989 Ayers ..... 52/169.12
5,052,741 A * 10/1991 Brown et al. ..... 296/191
5,907,933 A * 6/1999 Stanfill ..... 52/169.12
6,125,597 A * 10/2000 Hoffman et al. ..... 52/169.12
6,170,214 B1 * 1/2001 Treister et al. ..... 52/511
6,374,552 B1 * 4/2002 Price ..... 52/169.12
7,325,363 B2 * 2/2008 Davis ..... 52/169.12
7,681,362 B1 * 3/2010 Averitt ..... 52/169.12
7,685,781 B1 * 3/2010 Hatch ..... 52/169.12
8,657,363 B1 * 2/2014 Roush et al. ..... 296/186.1
2004/0006945 A1 * 1/2004 Price et al. ..... 52/605
2005/0088013 A1 * 4/2005 Dyer et al. ..... 296/191
2007/0120397 A1 * 5/2007 Layfield et al. ..... 296/180.4

* cited by examiner

*Primary Examiner* — Gregory Blankenship
(74) *Attorney, Agent, or Firm* — Thompson Coburn LLP

(57) ABSTRACT

A top rail secures skirting to a mobile home and comprises a panel back support portion and a top front rail connector portion spaced from one another by an under mount portion. The under mount portion extends between the top front rail connector portion and the panel back support portion. The top front rail connector portion and panel back support portion are generally parallel. The under mount portion extends transversely to the top front rail connector portion and the panel back support portion. The under mount portion is generally flat and allows mounting of the top rail to the underside of a mobile home. The top rail also includes a top front rail that is connectable with the top front rail connector portion. The top front rail and top front rail connector portion have interlocking geometry. The top front rail and top front rail connector portion are connectable.

20 Claims, 5 Drawing Sheets

METHOD AND APPARATUS FOR UNDER MOUNTED SKIRT FOR A MOBILE HOME

BACKGROUND AND SUMMARY

The disclosure relates to a method and apparatus for securing skirting to mobile homes. In particular, the discussion that follows relates to a top rail that has a panel back support portion and a top front rail connector portion that are spaced apart by an under mount portion. The under mount portion is configured to be secured to the underside of the mobile home such that the panel back support portion and top front rail connector portion depend therefrom. The spacing created by the under mount portion between the top front rail connector portion and panel back support portion is sufficient to receive a skirting panel therebetween. A top of the skirting panel may be inserted into the space between the top front rail connector portion and the panel back support portion and be held in place on the underside of the mobile home. A bottom of the skirting panel may be attached and secured to the ground with a bottom track. The bottom track may be secured into the ground with spikes. The skirting panel may extend between the top rail and the bottom track. The top rail may comprise a top front rail which connects or assembles with the top front rail connector portion to further secure the top of the skirting panel to the underside of the mobile home.

DETAILED DESCRIPTION

While the description that follows references a mobile home, the top rail described herein may be used in connection with any structure. Accordingly, the use of mobile home in the description that follows is for ease of illustration and should not be deemed limiting in any sense. Also, the terms left, right, top, bottom, front, and rear are used for the convenience of describing elements in the views of the drawings and are not meant to be limiting in any sense.

Figure 6:
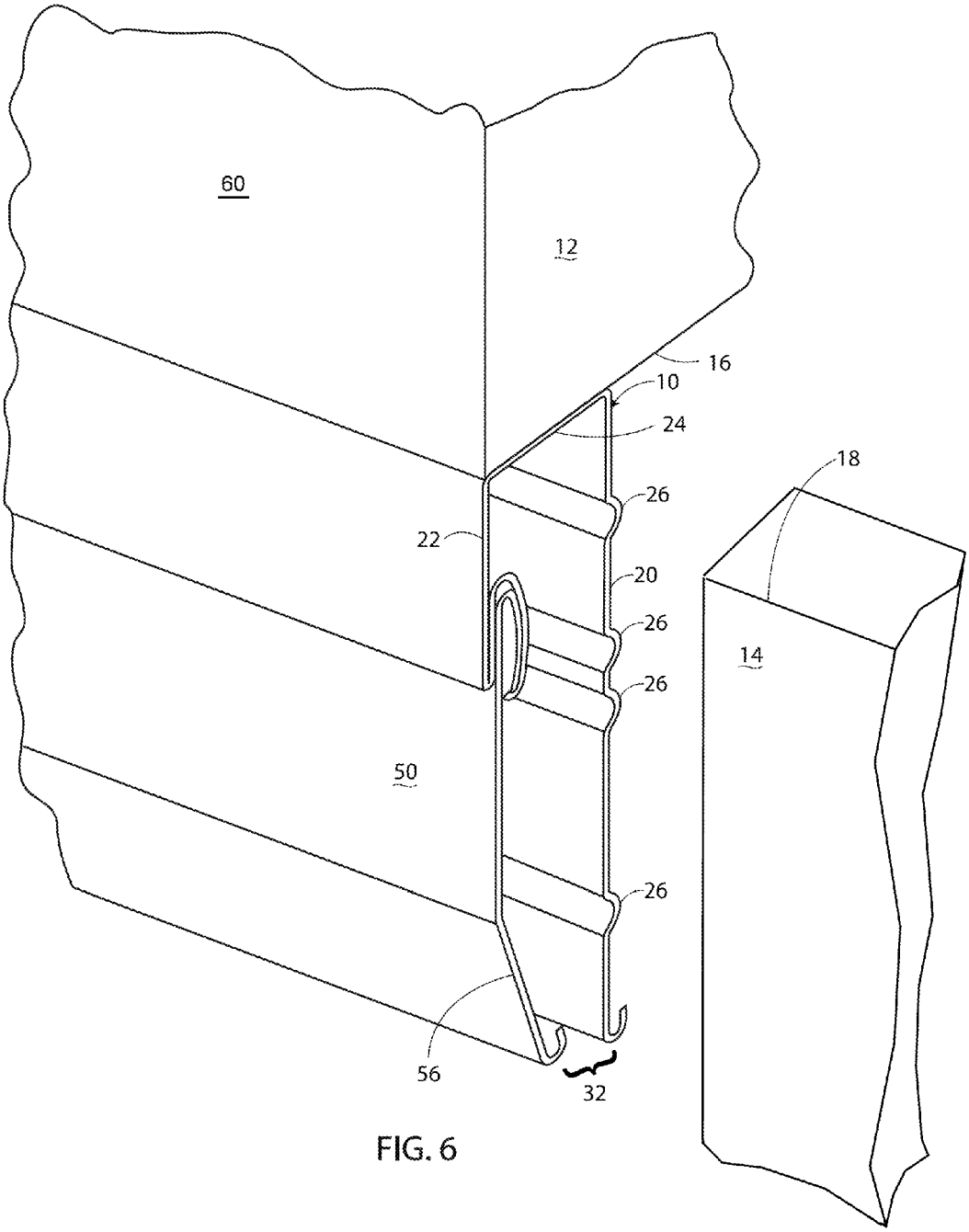
FIG. 6 shows a partial perspective view of a mobile home with the top rail of FIGS. 1 and 3 secured thereto with a skirting panel shown in an exploded form relative thereto for the purposing of illustrating additional detail.

FIG. 6 shows the general arrangement of a top rail 10, a mobile home 12, and a skirting panel 14. The top rail 10 enables the skirting panel 14 to be secured to a mobile home 12. More specifically, the top rail 10 may be mounted to an underside 16 of the mobile home around a periphery of the mobile home. The top rail 10 anchors a top marginal edge 18 of the skirting panel to the mobile home. A bottom marginal edge (not shown) of the skirting panel may be anchored to the ground with a bottom track (not shown). The bottom track may be anchored to the ground with spikes (not shown). The bottom track generally comprises a channel and the bottom marginal edge of the skirting panel may be received in the channel. Together the top rail and bottom track hold the skirting panel in place. The top rail may be made from a weather resistant, resilient material, such as rigid PVC, which allows sufficient deflection for insertion of the skirting panel within the top rail. The thickness of the top rail material may be 0.050 inches to 0.055 inches.

Referring to FIGS. 1-5, the top rail comprises 10 a panel back support portion 20 and a top front rail connector portion 22 which are spaced apart by an under mount portion 24. The panel back support portion 20 and top front rail connector portion 22 are generally parallel to each other with the under mount portion 24 extending transversely therebetween. The under mount portion 24 may be perpendicular to the top front rail connector portion 22. The under mount portion 24 may also be perpendicular to the panel back support portion 20. The panel back support portion 20 supports a rear surface (i.e., not outwardly exposed surface) of the skirting panel 14. The panel back support portion 20 may extend 7 inches from the under mount portion 24. Generally speaking, the panel back support portion 20 is not visible when installed and would be obscured by the skirting panel 14 once installed in the top rail 10. The panel back support portion 20 may have one or more grooves 26 extending longitudinally along the length of the panel back support portion. The grooves 26 may interlock with corresponding geometry on the back of the skirting panel 14 to aid in securing the skirting panel within the top rail 10.

Figure 1:
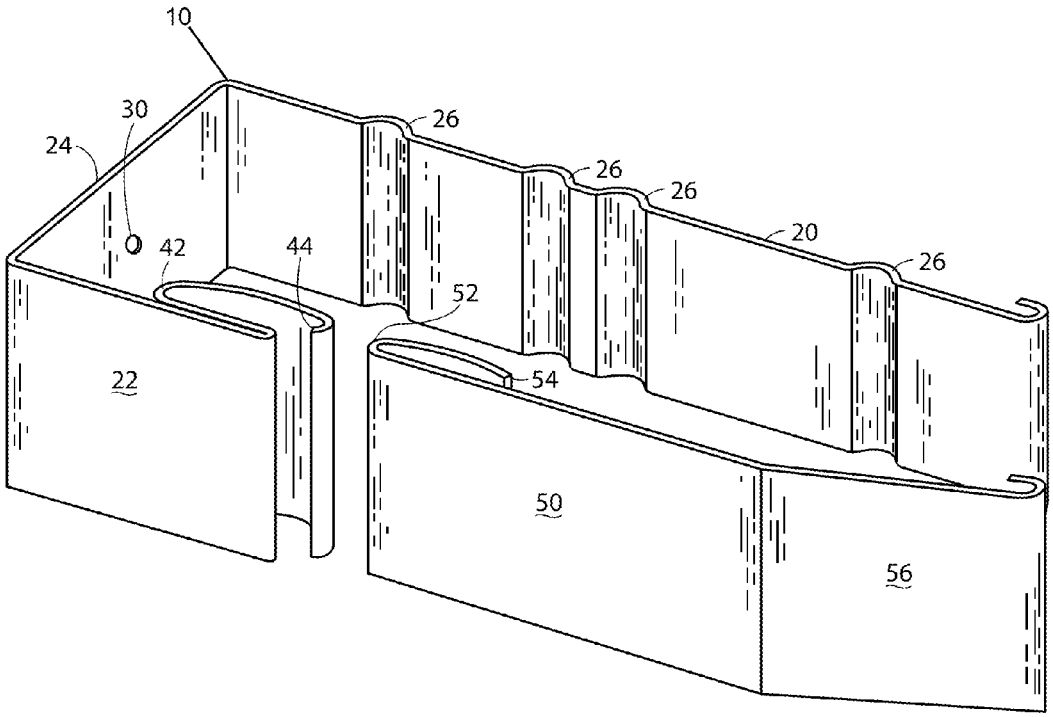
FIG. 1 shows a partial, exploded perspective view of a top rail.
Figure 2:
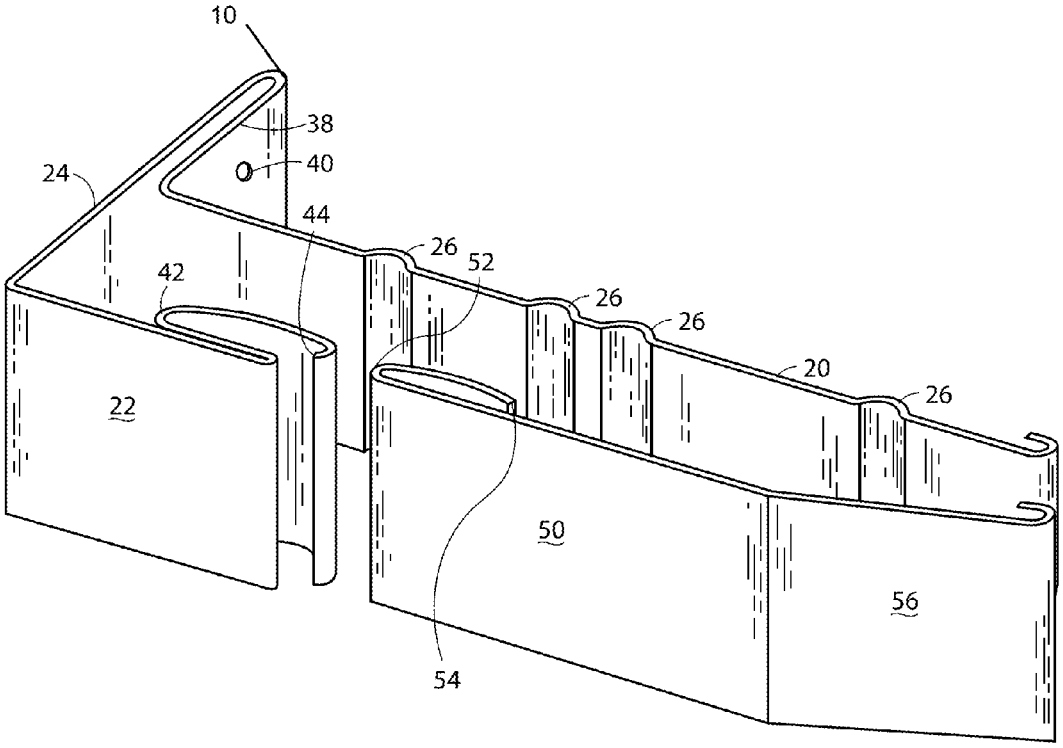
FIG. 2 shows a partial, exploded view of an alternate embodiment of a top rail.
Figure 3:
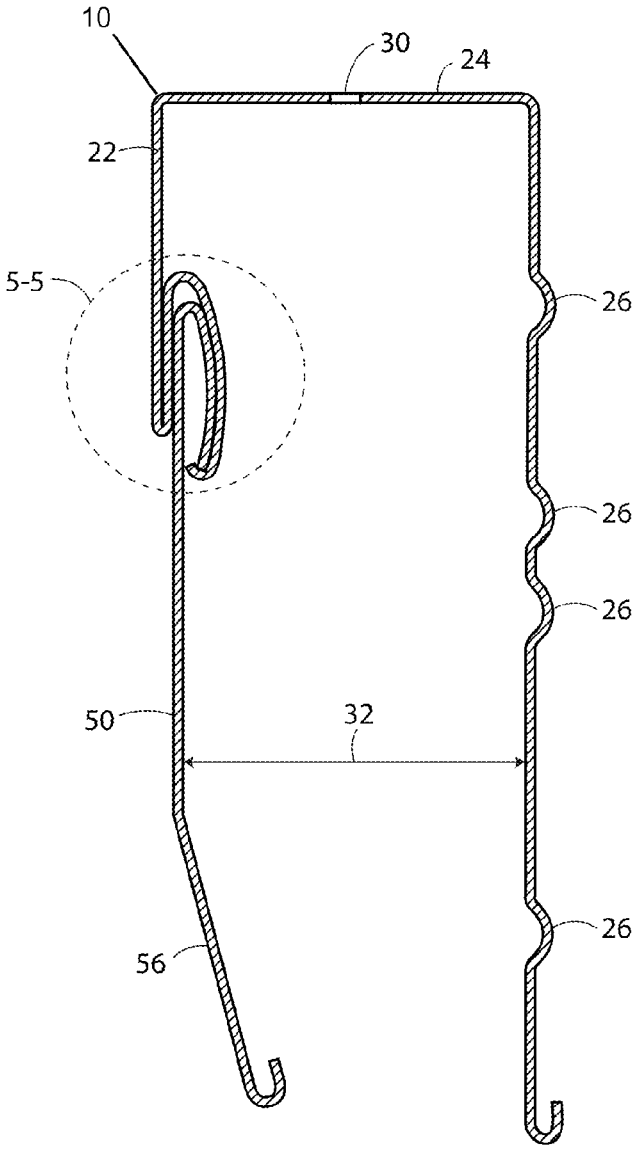
FIG. 3 shows a side, cross-sectional view of a top rail of FIG. 1.
Figure 4:
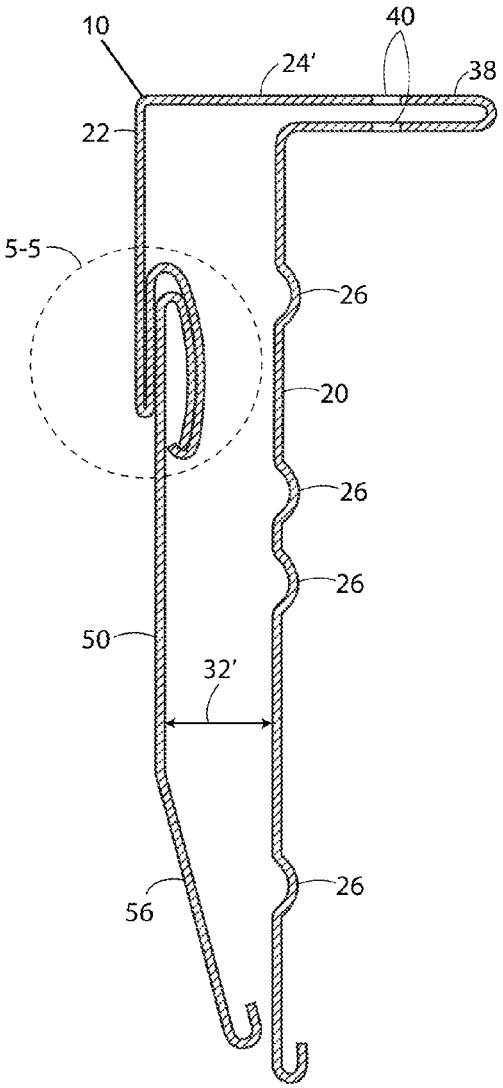
FIG. 4 shows a cross-sectional view of a top rail of the embodiment of FIG. 2.
Figure 5:
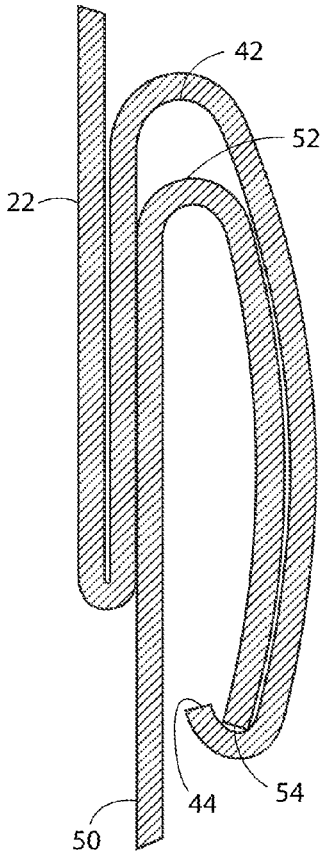
FIG. 5 shows a partial, enlarged cross-sectional view of detail area 5-58 of FIGS. 3 and 4.

The under mount portion 24 is generally flat and adapted to be mounted to the underside 16 of the mobile home structure 12. The under mount portion 24 may be formed with preformed holes 30 spaced along its longitudinal length to allow the use of mechanical fasteners to secure the top rail to the underside of a mobile home. Alternatively, the under mount portion 24 may be of sufficient thickness to allow mechanical fasteners to be directed through the under mount portion as desired, for instance, by mechanically driving screws or nails therethrough. In the embodiment of the top rail portion shown in FIGS. 1 and 3, the under mount portion 24 is dimensioned in such a way to space the panel back support portion 20 from the top front rail connector portion 22 to allow the formation of a channel 32 of sufficient width to receive an insulated skirting panel 14. For instance, the under mount portion may have a dimension of 2⅝ inches, thereby allowing an insulated panel to be inserted and held within the channel of the top rail. In the embodiment of FIGS. 2 and 4, the under mount portion 24' has an extension 38 formed by an overlap of the under mount portion. The extension 38 allows the effective width of the under mount portion to be reduced to thereby accommodate an uninsulated skirting panel (not shown). For instance, the partial doubling over of the under mount portion 24' may create an effective channel 32' with a dimension of 1 3/32 inches, although the under mount portion is 2⅝ inches. Thus, the extension may be roughly 1 17/32 inches. The extension 38 provides an access area to facilitate securing the top rail 10 to the underside of the mobile home 16. Mechanical fasteners may be directed through the extension 38 and into the underside of the mobile home. The extension 38 may have preformed holes 40 or fasteners may be mechanically driven through the extension and under mount portion in securing the top rail to the underside of the mobile home.

The top rail 10 further comprises the top rail connector portion 22. The top rail connector portion 22 is spaced from the panel back support portion 20 and is configured to receive a top front rail 50 discussed below to form an assembly comprising the top rail. The top front rail connector portion 22 may extend 2¼ inches from the under mount portion 24. The top front rail connector portion 22 may be formed as a groove 42. The top front rail connector portion 22 may be doubled over itself as shown with detail in FIG. 5 to form the groove 42. An edge of the groove 42 may have a tongue 44 that extends along the edge of the groove. The tongue 44 may aid in securing the top front rail 50 to the top rail connector portion 22. The top front rail connector portion 22, under mount portion 24, and panel back support portion 20 may be formed from resilient materials to allow the top front rail connector portion and the panel back support portion to be deflectingly moved apart to allow insertion of the skirting panel 14 therebetween.

The top rail 10 also comprises the top front rail 50 that may be assembled with the top rail connector portion 22 to form the assembly comprising the top rail. The top front rail 50 depends from the top front rail connector portion 22 to provide additional mounting stability and structural integrity for the top rail 10 and the skirting panel 14. Because the top front rail may be assembled with the top front rail connector portion to form the top rail, an installer may have better access to the under mount portion in the channel (for instance, the embodiment of FIG. 3) or the extension (for instance, the embodiment of FIG. 4), and manipulate tools and mechanical fasteners during installation, as opposed to configurations where the top front rail is integral and not detachable or assembleable with the top front rail connector portion (or integral with the under mount portion). By way of example and making reference to the embodiment of FIG. 3, a commonplace, conventional ⅜" drive drill with a conventional drive extension may be used in the channel 32 to drive fasteners through the under mount portion during installation without interference of the panel back support portion and top front rail connector portion. Similarly, by way of example and making reference to the embodiment of FIG. 4, a commonplace, conventional ⅜" drive drill with a conventional drive extension may be used outboard of the panel back support portion 20 to drive fasteners through the extension 38 and under mount portion 24' during installation without interference of the panel back support portion. The top front rail 50 assembled with the top front rail connector portion 22 form a panel front support portion of the top rail 10, thereby aiding in anchoring the skirting panel 14 to the mobile home. Once assembled, the top front rail and top front rail connector portion in combination may extend from the under mount portion roughly 6¾ inches. The top front rail 50 and top front rail connector portion 22 are ordinarily visible and would obscure the top marginal edge 18 of the skirting panel 14. The top front rail 50 may have a boss 52 which may be received in the groove 42 of the top front rail connector portion 42. As shown in the drawings, the boss 52 may be formed by doubling over a longitudinal end 54 of the top front rail 50. Thus, the end 54 of the top front rail 50 may be engaged by the tongue 44 extending along the groove 42, thereby further securing the top front rail to the top front rail connector portion. The top front rail 50 and top front rail connector portion 22 may be formed from resilient materials to allow the front rail and top front rail connector portion to be deflectingly moved apart to allow insertion of the top front rail boss 52 in the top front rail connector portion groove 42. The top front rail 52 may have a depending portion 56 which is obtusely angled such that when the top front rail 50 is assembled with the top rail connector portion 22, the depending portion 56 is angled toward the panel back support portion 20. The angled arrangement biases the marginal top edge 18 of the skirting panel 14 against the panel back support portion 20, thereby aiding in securing the skirting panel within the top rail. In the free state, the distal end of the depending portion 56 of the top rail of FIG. 3 may be 1 11/16 inches from the panel back support portion, and the distal end of the depending portion 56 of the top rail of FIG. 4 may be ¼ inches from the panel back support portion.

In installing the top rail 10, an installer may place the under mount portion 24 of the unassembled top rail (i.e., the top front rail connector portion, under mount portion, and panel back support together without the top front rail) adjacent the underside 16 of the mobile home 10 around the periphery such that the top front rail connector portion 22 is flush with exposed face panels 60 of the mobile home and structural members of the underside 16 of the mobile home. In this fashion, the facade 60 of the mobile home adjacent to the bottom foundation of the mobile home may be flush and aesthetically seamless with the outer surface of the top front rail connector portion 22. Next, the installer may mount the unassembled top rail to the underside of the mobile home with mechanical fasteners. Depending upon the embodiment of the top rail, the installer may direct mechanical fasteners through the under mount portion 24 by accessing the under mount portion in the channel 32 (i.e., in FIG. 3) or by directing mechanical fasteners through the extension 38 outboard of the panel back support portion 20 (i.e., FIG. 4). With the unassembled top rail in place along the peripheral bottom edge of the mobile home, skirting panels 14 may be inserted in the channel (FIG. 3, "32", FIG. 4, "32"). The skirting panels 14 may be inserted in the space formed between the top front rail connector portion 22 and the panel back support portion 20. By making triangular cuts in the top front rail connector portion and under mount portion, the top rail may be bent around corners of the mobile home as needed during installation. Once the unassembled top rail is installed along the peripheral edges of the bottom of the mobile home, the top front rail 50 may be assembled with the top front rail connector portion 22. The boss 52 of the top front rail 50 may be inserted into the groove 42 of the top front rail connector portion 22 and snapped in place such that the distal end 54 of the top front rail may lock with or engage the tongue 44 of the groove 42 of the top rail connector portion 20. The top front rail may be assembled with the top front rail connector portion prior to installation of the skirting panels, as may be desired depending upon the application.

Although the drawings show the top front rail with a boss and the top front rail connector portion having a groove, the cooperating interlocking geometry may be reversed and the top front rail may be formed with a groove and the top front rail connector portion may have a boss. The top front rail, under mount portion, and panel back support portion may be formed monolithically. The top front rail, under mount portion, and panel back support portion may be formed from a continuous extrusion. The top front rail may also be formed from a continuous extrusion.

Although the top rail described herein may be used in connection with skirting on the underside of the mobile home, it should be appreciated that the top rail may be used in other applications including the mounting of skirting to the underside of other structures and the mounting of other panels similar to skirting used in a mobile home. The use of the top rail in the description was for purposes of illustration in the context of the mobile home application and is not to be interpreted in any limiting sense.

In view of the foregoing, it will be seen that several advantages are achieved and attained. The embodiments were chosen and described to provide the best examples and their practical application to thereby enable others skilled in the art to best utilize the various embodiments and with various modifications as are suited to the particular use contemplated. As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A top rail for securing skirting to a mobile home comprising:

a panel back support portion and a top front rail connector portion spaced from the panel back support portion by an under mount portion, the under mount portion extending between the top front rail connector portion and the panel support portion, the top front rail connector portion and panel back support portion being generally parallel with the under mount portion extending transversely to the top front rail connector portion and the panel back support portion, the under mount portion being generally flat and configured to allow mounting of the top rail to an underside of the mobile home; and a top front rail configured to be assembled with the top front rail connector portion;

wherein the top front rail and top front rail connector portion have interlocking geometry such that the top front rail is releasably attachable with the top front rail connector portion in a manner where the top front rail is spaced from the panel back support portion a distance sufficient to accommodate skirting placed between the panel back support portion and the top front rail.

2. The top rail of claim 1, wherein the interlocking geometry of the top front rail and top front rail connector portion comprises a groove formed on one of the top front rail and top front rail connector portion and a cooperating boss formed on the other of the top front rail and the top front rail connector portion.

3. The top rail of claim 1, wherein the under mount portion creates a space between the top front rail connector portion and panel support portion of sufficient dimension to receive a skirting panel.

4. The top rail of claim 3, wherein the skirting panel is insulated.

5. The top rail of claim 1, wherein the under mount portion has holes to receive mechanical fasteners for mounting the top rail to the underside of the mobile home.

6. The top rail of claim 5, wherein the under mount portion holes are within the space formed between the top front rail connector portion and the panel support portion.

7. The top rail of claim 5, wherein the holes are positioned outboard of the panel support portion.

8. The top rail of claim 7, wherein the under mount portion has an extension configured to allow mounting of the top rail to the underside of the mobile home.

9. The top rail of claim 1, wherein the top front rail connector groove comprises a tongue configured to engage the top front rail when the top front rail is inserted into the groove of the top front rail connector portion.

10. The top rail of claim 1, wherein the top front rail connector, the under mount portion, and the panel support portion are formed monolithically.

11. A top rail adapted to be installed on the underside of a structure to form a channel extending along a bottom edge of the structure, the channel having opposing sides extending along a length of the channel and at least in part defining an opening into the channel, a first of the channel side forming a panel back support portion and the second of the channel sides being spaced from the first along a width of the channel, the second of the channel sides forming a panel front support portion, the channel sides being sufficiently resilient to be deflectingly moved to an apart position to allow a skirting panel to be inserted through the opening into the channel, the width of the channel being defined by an under mount portion, the under mount portion being configured to be attached to the underside of the structure, the panel front support portion comprising a top front rail and a top front rail connector portion, the top front rail and top front rail connector portion having interlocking geometry allowing the top front rail to be assembled with the top front rail connector portion to form the panel front support portion;

wherein the top front rail is releasably attachable with the top front rail connector portion in a manner where the top front rail is spaced from the panel back support portion a distance sufficient to accommodate skirting placed between the panel back support portion and the top front rail.

12. The top rail of claim 11, wherein the interlocking geometry of the top front rail and top front rail connector portion comprises a groove formed on one of the top front rail and top front rail connector portion and a cooperating boss formed on the other of the top front rail and the top front rail connector portion.

13. The top rail of claim 11, wherein the under mount portion creates a space between the top front rail connector portion and panel support portion of sufficient dimension to receive a skirting panel.

14. The top rail of claim 13, wherein the skirting panel is insulated.

15. The top rail of claim 11, wherein the under mount portion has holes to receive mechanical fasteners for securing the top rail to the underside of the structure.

16. The top rail of claim 15, wherein the under mount portion holes are within a space formed between the panel front support portion and the panel back support portion.

17. The top rail of claim 15, wherein the holes are positioned outboard of the panel back support portion.

18. The top rail of claim 11, wherein the under mount portion has an extension configured to allow mounting of the top rail to the underside of the structure.

19. The top rail of claim 11, wherein the top front rail connector portion comprises a groove with a tongue formed on the edge of the groove configured to engage the top front rail when the top front rail is inserted into the groove of the top front rail connector portion.

20. The top rail of claim 11, wherein the top front rail connector, the under mount portion and the panel support portion are formed monolithically.

* * * * *